US005213190A

United States Patent [19]

Furneaux et al.

[11] Patent Number: 5,213,190

[45] Date of Patent: May 25, 1993

[54] METHOD AND APPARATUS FOR TESTING COINS

[75] Inventors: David M. Furneaux, Berkshire; Timothy P. Waite, Surrey; John W. Bailey, Berkshire; Alan Ralph, Hampshire; Michael Chittleborough, Buckinghamshire, all of England; Cary Sagady, Downingtown, Pa.

[73] Assignee: Mars Incorporate, McLean, Va.

[21] Appl. No.: 868,551

[22] Filed: Apr. 14, 1992

[30] Foreign Application Priority Data

Apr. 15, 1991 [GB] United Kingdom ..... 9107979

[51] Int. Cl.[5] ..... G07D 5/08

[52] U.S. Cl. ..... 194/317; 194/334; 194/335

[58] Field of Search ..... 194/317, 318, 319; 73/163; 324/228, 229, 236, 651, 659

[56] References Cited

U.S. PATENT DOCUMENTS

| | | | |
|---|---|---|---|
| 3,749,220 | 7/1973 | Tabiichi et al. | 194/319 |
| 4,409,543 | 10/1983 | Sugihara | 324/659 X |
| 4,460,080 | 7/1984 | Howard | 194/317 |
| 4,946,019 | 8/1990 | Yamashita | 194/318 |
| 5,048,662 | 9/1991 | Yamashita et al. | 194/317 |

FOREIGN PATENT DOCUMENTS

| | | |
|---|---|---|
| 0051028 | 5/1982 | European Pat. Off. . |
| 0062411 | 10/1982 | European Pat. Off. . |
| 0203702 | 12/1986 | European Pat. Off. . |
| 84/04617 | 11/1984 | PCT Int'l Appl. . |
| 2093620 | 9/1985 | United Kingdom . |

OTHER PUBLICATIONS

Hagemaier, "Fundamentals of Eddy Current Testing", Chaps. 8-10, USA 1990.

*Primary Examiner*—Michael S. Huppert
*Assistant Examiner*—William M. Hienz
*Attorney, Agent, or Firm*—Davis Hoxie Faithfull & Hapgood

[57] ABSTRACT

A method of testing a coin in a coin testing mechanism, comprising subjecting a coin inserted into the mechanism to an oscillating field generated by an inductor, measuring the reactance and the loss of the inductor when the coin is in the field, and determining whether the direction in the impedance plane of a displacement line, representing the displacement of a coin-present point which is defined by the measurements, relative to a coin-absent point representing the inductor reactance and loss in the absence of a coin, corresponds to a reference direction in the impedance plane. The reactance and loss measurements may be taken by a phase discrimination method. Techniques are disclosed for compensating for phase error in the phase discrimination, for measuring the direction of the displacement line relative to a different axis in order to avoid measurement errors being a consequence of any phase discrimination phase error, for applying offsets to achieve advantages in signal handling, for making the measurements thickness-sensitive, and using the change in reactance as an additional coin acceptance criterion. Some of these refinements are usable independently of the phase discrimination method. Apparatus for carrying out the methods is also disclosed.

75 Claims, 9 Drawing Sheets

116
uP
136
A·D
112/114
106
108
110
132
134
130
P
Ci
104
+
103
102
P
Rd
T2
Rb
Rc
Ra
T1
0V

R
Rd
δRd
118''
118
X
Xd
θe
δXd

METHOD AND APPARATUS FOR TESTING COINS

FIELD OF THE INVENTION

This invention relates to a method and apparatus for testing coins.

BACKGROUND OF THE INVENTION

In this specification, the term "coin" is used to encompass genuine coins, tokens, counterfeit coins and any other objects which may be used in an attempt to operate coin-operated equipment.

Coin testing apparatus is well known in which a coin is subjected to a test by passing it through a passageway in which it enters an oscillating magnetic field produced by an inductor and measuring the degree of interaction between the coin and the field, the resulting measurement being dependent upon one or more characteristics of the coin and being compared with a reference value, or each of a set of reference values, corresponding to the measurement obtained from one or more denominations of acceptable coins. It is most usual to apply more than one such test, the respective tests being responsive to respective different coin characteristics, and to judge the tested coin acceptable only if all the test results are appropriate to a single, acceptable, denomination of coin. An example of such apparatus is described in GB-A-2 093 620.

It is usual for at least one of the tests to be sensitive primarily to the material of which the coin is made and, in particular, such a test may be influenced by the electrical conductivity, and in magnetic materials the magnetic permeability, of the coin material. Such tests have been carried out by arranging for the coin to pass across the face of an inductor, and hence through its oscillating field, and measuring the effect that the coin has, by virtue of its proximity to the inductor, upon the frequency or amplitude of an oscillator of which the inductor forms part. Most often it has been the peak value of the effect, achieved when the coin is central relative to the inductor, that has been measured.

However, measurements of this type are sensitive to the distance between the coin and the inductor, in the direction perpendicular to the face of the inductor, at the time when the measurement is made. This undesirable effect can be countered to some extent by arranging the mechanical design of the mechanism such that coins are always encouraged to pass the inductor at a fixed distance from it but this can never be achieved completely and requires design features which in other respects may be undesirable. The measurement scatter caused by variable coin lateral position may be allowed for by setting the coin acceptance limits wider, so that acceptable coins will always pass the test even though they pass the inductor at different distances from it, but this adversely affects the reliability of the mechanism in rejecting unacceptable coins. It is also known to utilise the combined effect of two inductors, one each side of the path of the coin, so that at least to some extent the effects of variation of coin position between the two inductors can cancel each other, but this involves the provision of a second inductor.

SUMMARY OF THE INVENTION

An object of the invention is to provide a method of testing a coin which is responsive to the material of the coin, and is relatively insensitive to the distance of the coin from a testing inductor.

The invention provides from one aspect a method of testing a coin in a coin testing mechanism, comprising subjecting a coin inserted into the mechanism to an oscillating field generated by an inductor, measuring the reactance and the loss of the inductor when the coin is in the field, and determining whether the direction in the impedance plane of a displacement line, representing the displacement of a coin-present point defined by the measurements relative to a coin-absent point representing the inductor reactance and loss in the absence of a coin, corresponds to a reference direction in the impedance plane.

The "impedance plane" as referred to above is a plane in which the reactance (reactive impedance) and the loss (resistive impedance) of a circuit or of an inductor are represented as measurements or vectors along two mutually perpendicular axes lying in that plane. The term "displacement line" will be explained later in relation to FIG. 1.

An embodiment will be described which makes inductance and loss measurements using a free-running oscillator. However, a different and preferred embodiment uses a phase discrimination method and this avoids the need to use large capacitors and enables all timing aspects of the measurement circuitry to be determined by the clock of a microprocessor, which simplifies operation.

The invention can be carried out using only a single inductor because the direction of the displacement line is substantially independent of the lateral position of the coin. This simplifies the electrical wiring required and, in a typical coin mechanism where the coin passgeway lies between a body and an openable lid, avoids the need to provide flexible wiring leading to an inductor mounted on the lid.

It will become apparent that in some of the embodiments to be described, the reference direction in the impedance plane is established as an angle relative to one of the reactance and loss axes.

The position of the coin-absent point in the impedance plane may not be constant, because the reactance of the coil itself, and the loss of the coil itself, may vary with temperature and consequently with time and also small changes in the geometry of the coin mechanism might occur.

In these circumstances, the reactance and the loss of the inductor are measured both when the coin is in the field, and when it is not. The direction of the displacement line is determined by the two points in respect of which the measurements have been taken. In particular, the two reactance measurements are subtracted, the two loss measurements are subtracted, and the ratio of the two differences is taken, this representing the tangent of an angle the displacement line makes with one of the axes.

The tangent can then be compared with the reference direction which may be established or stored also as the tangent of the corresponding angle for an acceptable coin, represented, of course, as a number in digital form when digital processing and storage are being used for implementation.

It is possible that movement of the coin-absent point in the impedance plane may not occur to a significant degree, or possibly steps can be taken to prevent such movement from occurring by compensation techniques. In such circumstances, instead of the reference information being only an angle, it may constitute for example a set of stored coordinates in the impedance plane which together define a reference displacement line the direction of which is the reference direction and the position of which is such that it extends through the substantially fixed coin-absent point. Then, the determination of whether the direction of the displacement line corresponds to the reference direction need not involve actually measuring the coin-absent point. It can be assumed that that point has not changed, so the correspondence of the two directions, or otherwise, can be determined simply by checking whether the coin-present point lies on the reference displacement line. If it does, then the coin will have caused displacement of the coin-present point in the direction of the reference displacement line.

In a further form of the invention, the reference direction is established as an angle relative to the coin-absent total impedance vector of the inductor, instead of relative to the loss or reactance axes. This is of particular value, as will be explained below, when the reactance and loss measurements are taken by a phase discrimination method. Using a phase discrimination method has advantages, which are mentioned above, but also can introduce errors due to reference signals employed not being accurately phased. Measuring the direction of displacement of the impedance plane point caused by the coin relative to the total impedance vector of the inductor and establishing the reference direction also as an angle relative to that total impedance vector reduces or eliminates such errors.

Using a phase discrimination method has the advantages already mentioned, but also can introduce errors due to reference signals employed not being accurately phased.

From a further aspect, and irrespective of whether or not a phase discrimination method is used in ascertaining the direction of the displacement line, a determination is made whether the direction of the displacement line corresponds to a reference direction in the impedance plane appropriate to a particular coin type and, further, it is determined whether the difference between the coin-absent and coin-present values of the reactance of the inductor corresponds to a reference value appropriate to the same particular coin type.

This additional test enables discrimination between different coin types in accordance with their diameters, coin diameter being a characteristic to which the direction of the displacement line in the impedance plane is not very sensitive.

In the preferred embodiment that will be described, the direction of the displacement line is computed from signal ratios. Because ratios are taken, the result is independent of the gain of the channel which handles the relevant signals. However, when it is also desired to use as an acceptability criterion the difference between the coin-present and the coin-absent reactance, then the gain of the channel becomes important.

A further feature of the invention, usable irrespective of whether the measurements are taken using a phase discrimination technique, or not, comprises compensating for the effect of varying system gain on said difference between reactance values by simulating, from time to time, a predetermined change in the reactance of the inductor when a coin is not in its field, detecting the resulting change in a signal dependent on said reactance which signal has been subjected to said system gain, comparing the detected change with a reference value, applying to said reactance-dependent signal a compensation factor derived from the result of said comparison such as to adjust that signal to substantially correspond with the reference value, and maintaining the application of said compensation factor until the next time said change is simulated.

From yet another aspect the invention provides a method of testing a coin in a coin testing mechanism, comprising subjecting a coin inserted into the mechanism to an oscillating field generated by an inductor, measuring the reactance and the loss of the inductor when the coin is in the field, and determining whether the direction in the impedance plane of a displacement line, representing the displacement of a coin-present point defined by the measurements relative to a coin-absent point representing the inductor reactance and loss in the absence of a coin, corresponds to a reference direction in the impedance plane, and wherein the frequency of the oscillating field generated by the inductor is sufficiently low that its skin depth for the coin material is greater than the thickness of the coin, whereby the direction of said displacement line is influenced by the thickness of the coin being tested.

Again, such a method may be used whether or not the reactance and loss measurements are taken by a phase discrimination method.

A further aspect of the invention is a coin testing mechanism for carrying out methods in accordance with the invention as referred to above.

BRIEF DESCRIPTION OF THE DRAWINGS

In order that the invention may be more clearly understood, embodiments thereof will now be described, by way of example, with reference to the accompanying diagrammatic drawings in which.

DETAILED DESCRIPTION

Figure 1:
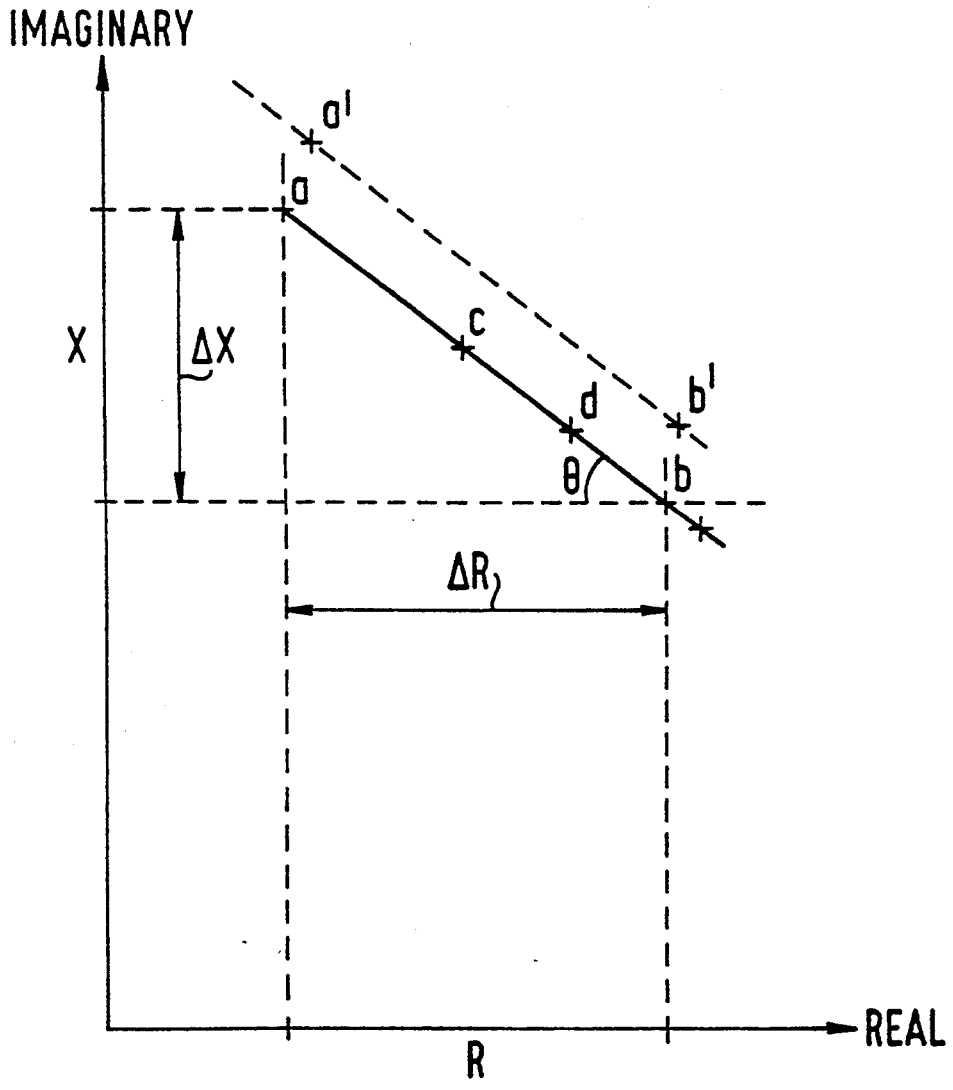
FIG. 1 represents the impedance plane for the inductor of the coin testing apparatus shown in FIG. 2.
Figure 2:
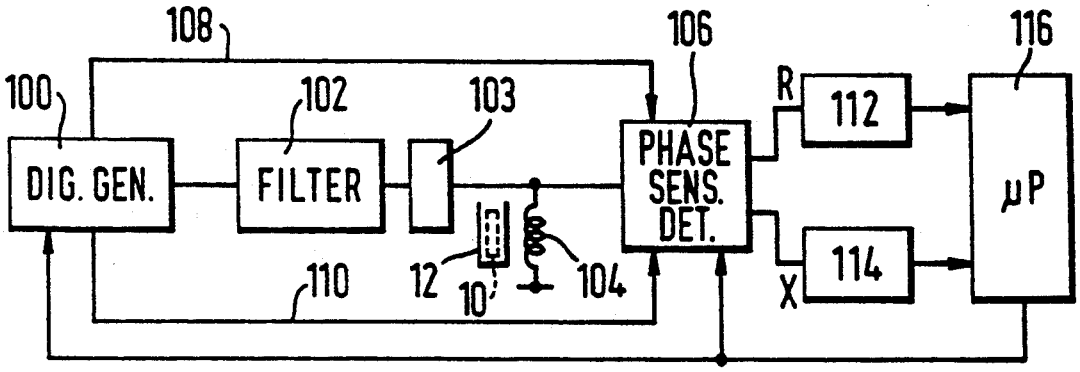
FIG. 2 shows schematically a circuit for developing the X and R signals, using a phase discrimination method.

In FIG. 1 the vertical axis represents the imaginary component, i.e. the reactance X, of the impedance of an inductor such as the coil 104 of the apparatus shown in FIG. 2, as affected by any coin which may be near it. The horizontal axis represents the real component of the impedance i.e. its resistance or loss R, again as affected by any coin which may near the coil.

If X and R are measured when no coin is near the coil, the resulting values will be characteristic of the coil alone and, in the impedance plane (which is the plane which FIG. 1 represents) they will define a point a.

If a coin is then brought into the proximity of the coil, both the effective reactance and the effective loss of the coil will change, that is to say that if X and R are now measured for coil plus coin the resulting values will define a different point b in the impedance plane.

If the coin, in its central position relative to the coil, is moved perpendicularly towards and away from the face of the coil, it is found that the point b moves along a substantially straight line a-b.

Consequently, if the same coin is passed several times through the same apparatus, and each time X and R values are measured when it is central relative to the coil, but it is at a different distance from the coil each time, the resulting X and R measurements will define three points a, c and d in the impedance plane and, although the X values for these points will all be different, and so will the R values, each pair of values will define a point lying on the same line a-b.

In the course of time, due to ageing of circuit components, the effects of changing temperature, or to a change in the physical configuration of the apparatus, the position of the line a-b may move in the impedance plane, for example to the parallel position a'-b', but its gradient, the angle $\theta$, remains the same for the same type of coin. That is to say, the direction of the line on which the point representing the coin/coil combination in the impedance plane has moved relative to the coil-only point (herein called the "displacement line") is indicative of coin type and substantially independent of the lateral position of the coin.

Hence, if a reference value for $\theta$ can be established, which is characteristic of a particular acceptable type of coin in a particular coin testing mechanism, and then the value of $\theta$ for unknown coins is measured in the same apparatus, a comparison of the measured values of $\theta$ with the reference value will give an indication of the acceptability of the unknown coins, so far as the coin material characteristics which influence $\theta$ are concerned, which is independent of the distances at which the respective coins passed the coil and independent of time-varying factors which do not cause variation of the angle $\theta$ for the acceptable coin type.

If the coin includes magnetic, high-permeability, material, the loss is increased by the additional factor of hysteresis loss, and the reactance may increase instead of decreasing, since the coin will, to a degree, act as a core for the coil. In such cases the angle $\theta$ will be in the opposite sense from that shown in FIG. 1. This may be used to discriminate between magnetic and non-magnetic coins.

There is a further benefit to the above technique over prior techniques in which measured X and R values are individually compared with references. The references usually are not specific values, but upper and lower limits defining a range. Where different measured values are compared with respective reference ranges, a coin will be accepted if each measured value lies anywhere within its respective reference range. If, for example the measurements were X and R measurements as discussed above, a coin would be accepted even if both its X and R measurements lay at the limits of the respective ranges, even if this combination of measurements is likely to be a result of the coin actually being one which should not be accepted. In the present technique, a coin whose X measurement would lie at the limit of an individual reference range for X would only be accepted if its R measurement would have been displaced from the centre of the reference range for R in one direction, but not if it is displaced in the other direction, the latter being indicative that this particular combination of X and R measurements suggests the coin ought to be rejected even though it would have been accepted using the prior technique.

In the apparatus that will be described, values of X and R are measured when no coin is present, and then when a coin is adjacent to the coil, the X values are subtracted and the R values are subtracted so as to give $\Delta X$ and $\Delta R$ as indicated in FIG. 1, these values indicating by how much the coin has changed the effective reactance and the effective loss of the coil, and $\Delta X/\Delta R$ is taken; this is $\tan\theta$ for the unknown coin. Acceptability is tested by comparing this with a reference value of $\tan\theta$ which corresponds to the ratio of the measured values of $\Delta X$ and $\Delta R$ for an acceptable coin.

The apparatus of FIG. 2 will now be described in detail. Means is provided for positioning a coin shown in broken lines at 10 adjacent to a coil 104, the means being shown schematically as a coin passageway 12 along which the coin moves on edge past the coil. A practical arrangement for passing a moving coin adjacent to an inductive testing coil is shown, for example, in GB-A-2 093 620. As the coin 10 moves past the coil 104, the total effective loss of the coil increases, reaching a peak when the coin is centred relative to the coil, and then decreases to an idling level. The total effective reactance decreases, to a negative peak, and then comes back to its idling level. In the present example the apparatus utilises the peak values.

The circuit of FIG. 2 uses a phase discrimination technique for separating the real (R) and imaginary (X) components of the coil impedance. It comprises a signal source consisting of a digital frequency generator 100 whose output is filtered by a filter 102 whose output controls a constant current source 103 whose output drives the coin sensing coil 104. Thus, components 100, 102, 103 appear to the coil as a constant current source. The output of generator 100 approximates to a sine wave but, being generated digitally, it contains higher harmonics and the function of the filter 102 is to filter these out.

The signal across coil 104 is applied to a phase sensitive detector 106 which also receives, from the generator 100, two reference signals. One reference signal is on line 108 and ideally is in phase with the voltage across coil 104 so as to enable the phase sensitive detector to produce the signal representing X at one of its outputs. On another line 110 a reference signal is applied which is at 90° to the first reference signal and in phase with the coil current, so as to enable the phase sensitive detector to develop at another output thereof a signal indicative of R of the coil. It should be noted that the voltage signals applied to and output from the phase sensitive detector can only be relied on as measures of X and R so long as the peak coil current is constant with time.

The R and X signals are filtered by respective filters 112 and 114 and the resulting signals are applied to a microprocessor 116 which is programmed to carry out the necessary further processing of the signals, and also to carry out the further functions required for coin validation. Additionally, microprocessor 116 controls signal generator 100 so that it will generate alternately the reference signals on lines 108 and 110, and also switches the output of the phase sensitive detector 106 between the R and X output channels in synchronism with the switching of the reference signals.

Figure 3:
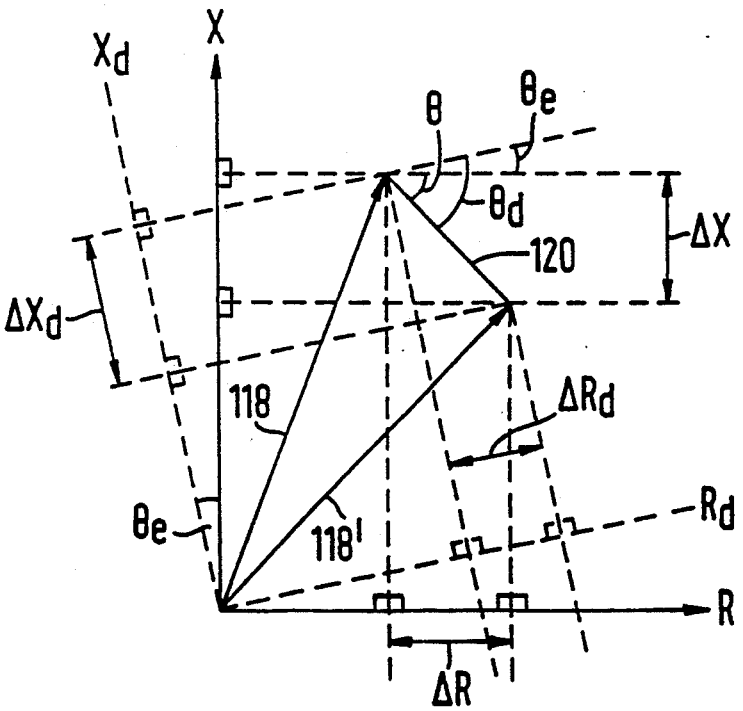
FIG. 3 is a further impedance plane diagram useful in explaining operation of the circuit of FIG. 2.

Referring to FIG. 3, vector 118 represents the total impedance of coil 104 when no coil is present and hence its end corresponds to point a in FIG. 1. When a passing coin is centred on the coil, vector 118 has been shifted along displacement line 120 to become vector 118'. The end of vector 118' corresponds to point b c or d in FIG. 1. Microprocessor 116 receives from the phase sensitive detector 106 signals representing the X and R components of both of those vectors and hence can compute $\Delta X$ and $\Delta R$ and their ratio $\Delta X/\Delta R$ which is $\tan\theta$ as referred to before.

It is to be noted that because the angle $\theta$ is calculated from differences between X values and between R values, any offsets inadvertently applied within the circuitry to the signals representing X and R do not cause errors, because they will leave the difference values unaffected.

Although the inductor is shown as a single coil, it may have other configurations, such as a pair of coils opposed across the coin passageway and connected in parallel or series, aiding or opposing.

Figure 4:
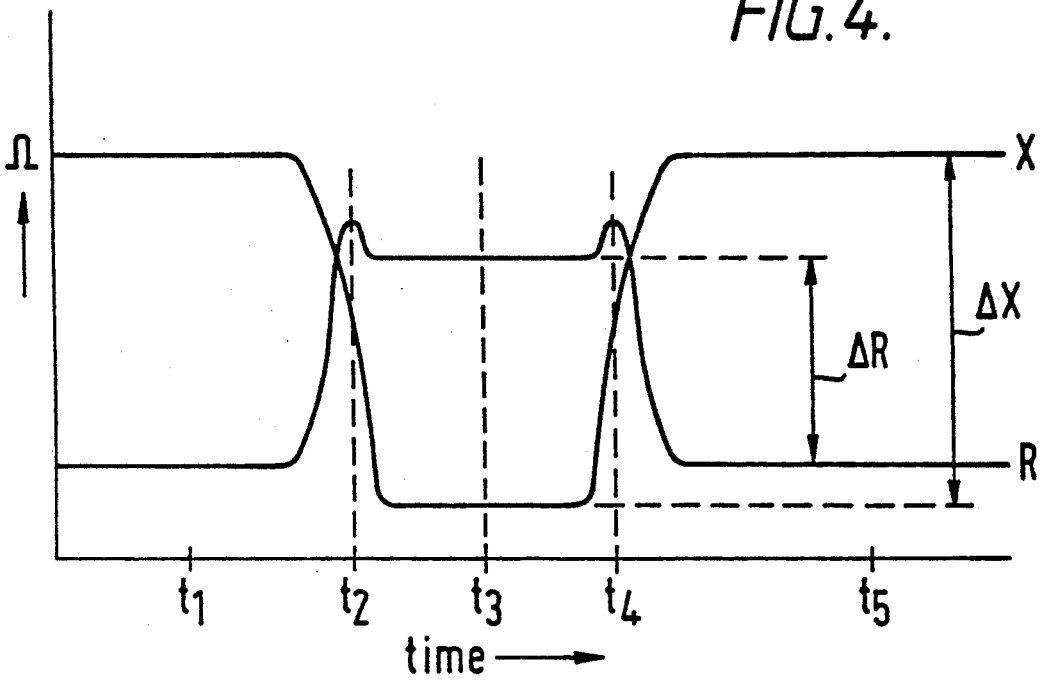
FIG. 4 shows how X and R vary with time as a coin passes the inductor.

FIG. 4 shows how, for a single coin, X and R (both measured in ohms) vary with time as a coin passes the coil. $\Delta X$ and $\Delta R$ are also shown. It can be seen that whereas X reaches a relatively smooth and flat negative peak during the middle part of the passage of the coin, R has a relatively smooth plateau in the central part of its peak, with a small further superimposed peak at each end of the plateau, these small peaks being caused by edge effects as the rim of the coin passes the centre of the coil.

Figure 5:
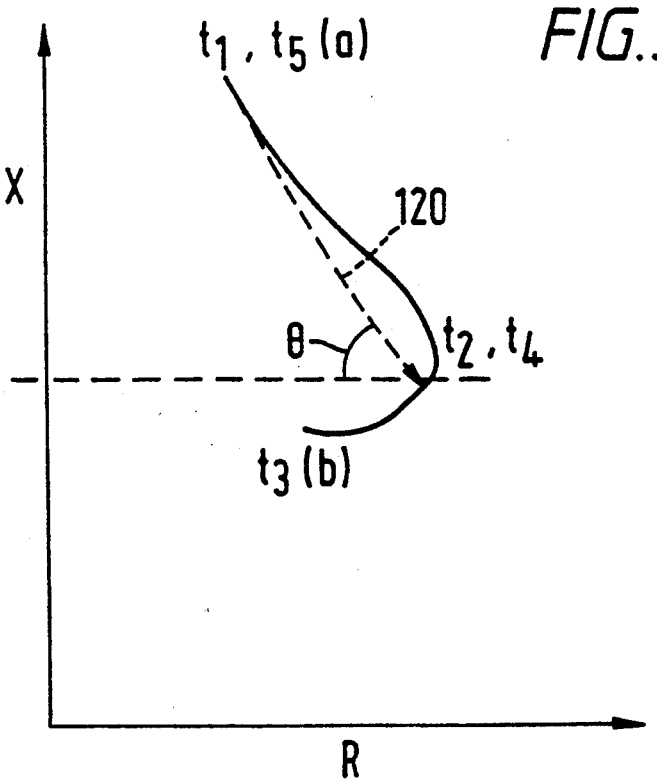
FIG. 5 shows how an angle $\theta$ varies with time as a coin passes the inductor.

The locus of the point defined by the X and R values in the impedance plane as the coin passes the coil is shown by the hook-shaped curve in FIG. 5.

In that plane, before the coin has arrived i.e. at time $t_1$ the X-R coordinate point is at the top of the hook in FIG. 5, this corresponding to point a in FIG. 1. When the coin has arrived and is centred relative to the coil at time $t_3$, the point defined by the X-R measurements has moved to the tip of the hook, this corresponding to point in FIG. 1. The existence of the small added peak at the beginning of the main peak of the R measurement causes the point to describe the bulged part of the hook in FIG. 5 as the coin moves towards the central position. As the coin moves on from the central position and departs from the coil, so the point moves back round the hook from $t_3$ to $t_4$ to $t_5$.

It will be appreciated that the vector 120 from the coin-absent point to the point defined by the present X-R measurements of the moving coin lengthens and rotates clockwise until it reaches the tip of the hook and then performs the reverse movement.

It can be appreciated from this that computations may be carried out by storing the variable values of $\Delta X$ and $\Delta R$ occurring throughout the passage of the coin, computing the corresponding time-varying values of $\Delta X/\Delta R$ (i.e. $\tan\theta$) and then detecting the maximum of the computed value of $\tan\theta$, this maximum being compared with the reference value of $\tan\theta$ for an acceptable coin.

Although it is preferred to take the measurements on a moving coin, as described, to enable coins to be tested in rapid succession, it is also possible for the loss and reactance to be measured on a stationary coin.

Advantages of driving a coil as in FIG. 2, compared with techniques using a free-running oscillator, are that no large capacitors are needed and that all signals in the sensing circuitry can be synchronised to the microprocessor clock frequency, which is a significant simplification. However, there is a possibility that the phase discrimination method of FIG. 2 could be rendered less accurate than is ideally desirable, if the phases of the reference signals on lines 108 and 110 (which define the phase discrimination axes) are, or become, incorrectly related to the phase of the current in coil 104 (which defines the true R and X axes).

This is possible, because the relative accuracy of these phases is limited by the resolution of the digital generator 100, and because the analog filter 102 itself introduces an unknown phase delay in the signal applied to coil 104 which phase delay may change with temperature. The effect of phase error is that the components of the total impedance vectors 118 and 118' in FIG. 3 would be measured relative to discrimination axes $X_d$ and $R_d$ which are rotated relative to the true reactance and loss axes. Thus, the calculated value $\Delta X_d$ becomes larger than the desired true value $\Delta X$ while the calculated value $\Delta R_d$ becomes smaller than the desired true value $\Delta R$. Their ratio $\Delta X_d/\Delta R_d$ is the tangent of the angle $\theta_d$ which, as can be seen, is larger than the angle $\theta$ that was intended to be measured. To put it another way, although angle $\theta$ is being measured, it is being measured with an amount of error which is dependent on the angular error of the phase discrimination axes.

Figure 6:
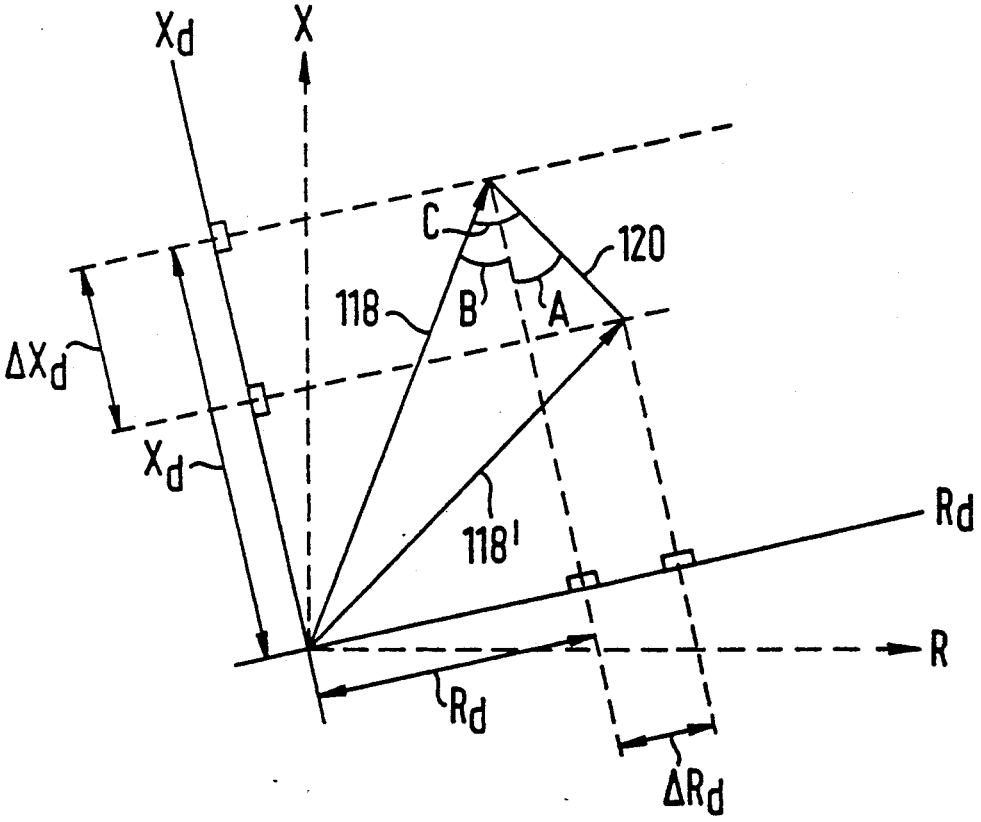
FIG. 6 is a further impedance plane diagram useful in explaining a further developed method of testing coins in accordance with the invention.

One technique for eliminating this will be described with reference to the impedance plane diagram shown in FIG. 6. This corresponds to FIG. 3 except that, to facilitate an understanding, the angularly displaced discrimination axes $X_d$ and $R_d$ are shown in full lines while the true X and R axes are shown in broken lines. An important point to note is that the error in the discrimination axes does not alter the shape of the triangle formed by the total impedance vector 118 when the coin is absent, the total impedance vector 118' when the coin is present, and the displacement line 120 which represents the displacement of the end-point of vector 118' relative to the end-point of the vector 118. That shape, and consequently the internal angle indicated at C, is determined solely by the lengths and directions of the two total impedance vectors 118 and 118' and these are independent of any phase error.

Measurements taken relative to the discrimination axes $X_d$ and $R_d$ can be used to derive the angle C, as follows. It is to be noted that angle C is equal to the sum of angles A and B as indicated in FIG. 6. FIG. 6 indicates that $R_d/X_d$ is the tangent of angle B so that angle B can be computed from those measured values. Also, the tangent of angle A is $\Delta R_d/\Delta X_d$, so that angle A can be computed from those difference values. Angle C is arrived at by summing the computed angles A and B. By thus taking vector 118 as the axis relative to which the direction of displacement line 120 is measured, instead of attempting to measure its direction relative to the true R and X axes which, as explained may introduce error owing to the unknown phase error in the phase discrimination process, a coin testing criterion is arrived at which is independent both of the lateral position of the coin relative to the testing coil and of phase error that might be present in the circuitry used for the phase discrimination technique.

It can be shown that, provided the angles A and B are such that the product of the tangents is much less than 1 (which very often will be the case in practice), then the tangent of angle C is simply $\Delta R_d/\Delta X_d$ plus $R_d/X_d$. Thus, in these circumstances, processing is simplified by measuring the direction of displacement line 120 in terms of the sum of the tangents of the angles A and B.

In general, it should be understood that where angles referred to herein are sufficiently small they can be represented to an acceptable degree of accuracy by their tangents, and in these circumstances the terms "tangent" and "angle" should be taken each to include the other.

Figure 7:
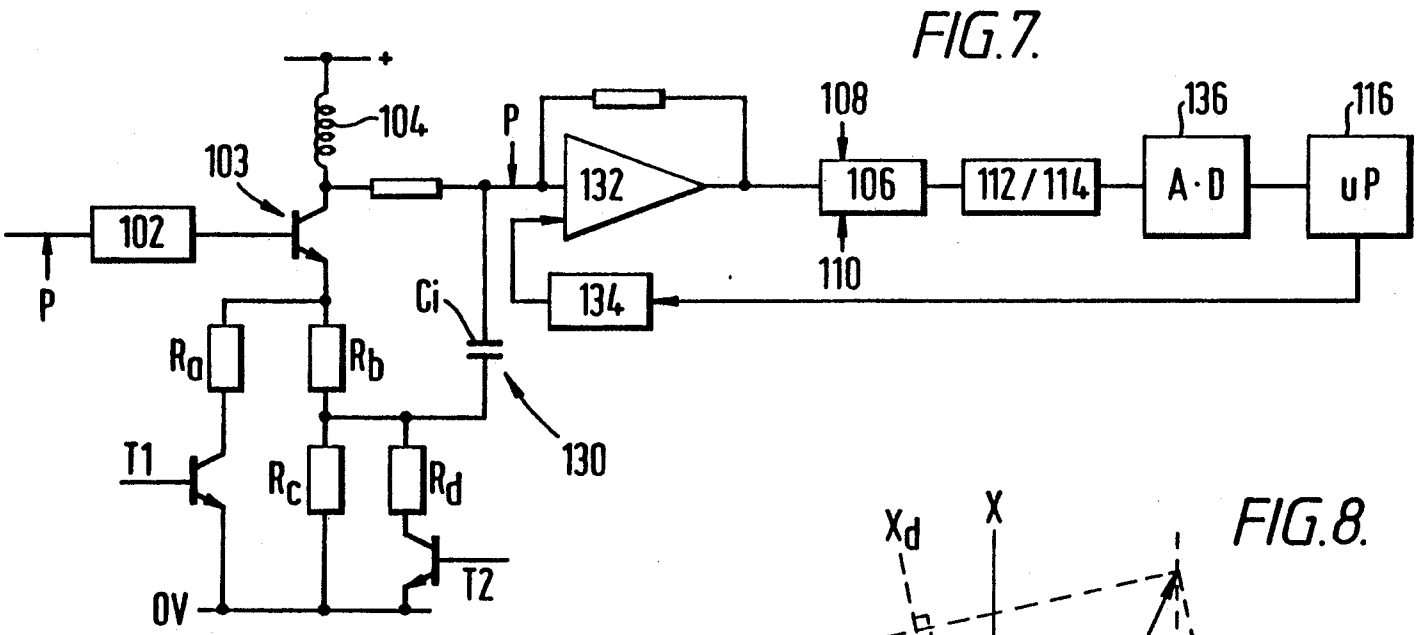
FIG. 7 illustrates a substantial part of a circuit similar to that of FIG. 2 but including additional features.

FIG. 7 shows various additions to the basic phase discrimination measurement type of circuit as shown in FIG. 2. In FIG. 7, components corresponding to those already described with reference to FIG. 2 have been given the same reference numerals as in FIG. 2 and will not be described again.

In FIG. 7 the constant current source is in the form of a transistor 103 and associated components. The additional components as compared with FIG. 2 are a calibration and offset circuit generally indicated at 130, a pre-amplifier 132 for amplifying the X and R signals, which are taken from the lower end of coil 104, prior to their application to the phase sensitive detector 106, a second offset circuit 134, and a digital-to-analogue converter 136 for converting the outputs of the filters 112 and 114 to digital form for handling by the microprocessor 116. A single filter or integrator 112/114 is shown in FIG. 7, this being equivalent to the two separately shown circuits 112 and 114 in FIG. 2. In practice, it would be preferred to use a microprocessor which actually incorporates the analogue-to-digital converter 136.

It should be appreciated that the output signal from coil 104 is constantly being amplified by the pre-amplifier 132 as at this stage the X and R signals are simply the in-phase and quadrature components, respectively, of the coil voltage signal. Thus, pre-amplifier 132 is serving as a common channel for both the X and R signals. Phase sensitive detector 106 separates the X signal from the R signal by developing at its output the X signal when the in-phase (with the coil voltage) reference signal is being applied on line 108, and the R signal when the quadrature-phase reference signal is being applied on line 110. Consequently, the circuit components from the output of phase sensitive detector 106 to microprocessor 116 are serving as a common channel for the X and R signals but at any one moment are handling only one or the other of them.

A first significant function of the FIG. 7 circuitry is to provide an alternative manner of dealing with the problem caused by angular displacement of the phase discrimination axes relative to the true X and R axes; that is to say, alternative to the method previously described with reference to FIGS. 3 and 6 in which the angle C between the displacement line 120 and the total impedance vector 118 was calculated instead of the error-influenced angle $\theta_d$.

The first step is to measure the phase-error angle $\theta_c$ (see FIG. 3) in a way which will be described below. It can be seen from FIG. 3 that $\theta_c$ is the difference between the desired angle $\theta$ and the erroneous angle $\theta_d$. Once $\theta_c$ is known, either or both of two steps can be taken. First, the microprocessor 116 can adjust the digital generator 100 such that the phases of the reference signals on both lines 108 and 110 are shifted in a direction tending to reduce $\theta_c$ to zero. This will usually not be possible because, since generator 100 is digital, the phases of its outputs can only be adjusted in steps and so normally there will be a residual value of $\theta_c$ which cannot be eliminated by adjustment. However, since $\theta_c$ is being measured, the residual value is known and can be subtracted from the erroneous measured angle $\theta_d$ to obtain the true value $\theta$. It is of course preferable for the value of angle $\theta_c$ to be reduced by adjustment so far as possible because this renders more accurate the simplifying assumption that an angle and its tangent are equal, as discussed above. The manner in which $\theta_c$ is measured will now be described with reference to FIG. 7.

The principle is to simulate, by operation of the calibration and offset circuit 130, a change in the reactance in the coil 104 when there is no coin in its field. It can be appreciated from a study of FIG. 3 that if the phase-error angle $\theta_c$ were 0, and the X component of the coil impedance vector 118 were changed without changing its R component, then there would not be any change either in the R component as perceived or measured at the output of the phase sensitive detector 106. However, if the phase-error angle $\theta_c$ is not 0, so that in FIG. 3 axis $R_d$ does not coincide with axis R, there will be a change in the R value as measured along the axis $R_d$.

Figure 8:
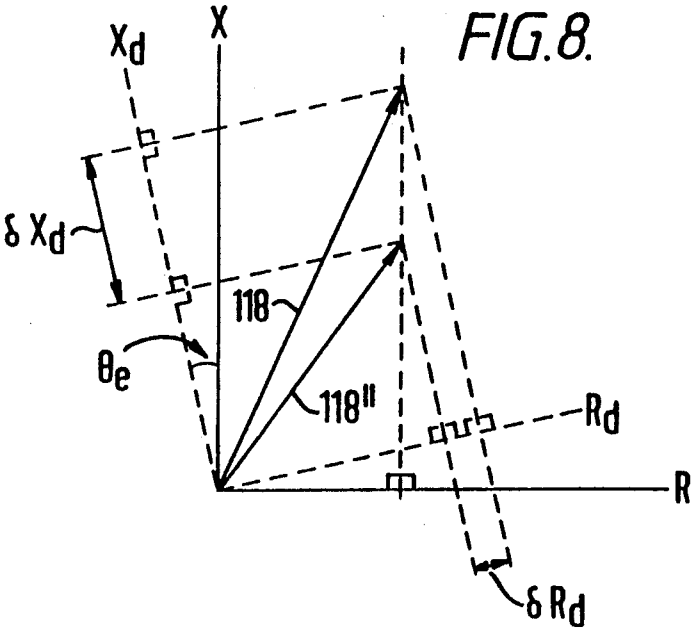
FIG. 8 is a further impedance plane diagram useful in understanding the functioning of the circuit of FIG. 7.

This can be better understood with reference to FIG. 8. It shows how, when a simulated change $\delta X_d$ is imposed on the X-component of the total impedance vector 118, converting it to vector 118'', there is no change in its R component as measured along the true R axis. However, when the phase discrimination axes $X_d$ and $R_d$ are in error by an angle $\theta_c$ as before, it can be seen that as measured on axis $R_d$, there is a change $\delta R_d$ in the measured R value. It can also readily be seen from FIG. 8 that $\delta R_d/\delta X_d$ is the tangent of angle $\theta_c$.

The calibration and offset circuit 130 in FIG. 7 simulates the change in the coil impedance X component, and makes sure that the simulation does not affect the coil R component, and then the relationship between the change in R as measured from the output of phase sensitive detector 106, and the change in the X measurement, is used as a basis for computing the error angle $\theta_c$.

The normal operating configuration of calibration and offset circuit 130 is with transistor T2 switched off and transistor T1 switched on. The current in coil 104 is then split between series resistors Rb and Rc on the one hand and the parallel resistor Ra on the other hand. These are all precision resistors. It needs to be remembered that in the FIG. 7 circuit it is that voltage component across coil 104 which is in phase with the current through coil 104 that is being taken as a measure of the coil loss R. This is only a true representation so long as the magnitude of the coil current remains constant. It is the value of the voltage component across coil 104 that is 90° out of phase with the coil current that is being taken as a measure of coil reactance X. In fact, this latter voltage has an offset applied to it for a reason which will be described later, by tapping between resistors Rb and Rc to obtain a voltage which is in phase with the coil current, changing the phase of that tapped-off voltage by 90° by means of capacitor Ci, and applying the resulting phase-shifted voltage to the input of the pre-amplifier 132. This offset voltage is 180° out of phase with the imaginary, or reactance-related, component of the voltage across coil 104 and so the effect is simply to apply a fixed offset to the voltage component which, at the input of pre-amplifier 132, represents the coil reactance X. This offset voltage is A.C. and it is phased such that it will not in itself affect the loss-related component of the input voltage to pre-amplifier 132.

To measure the phase error, transistor T2 is switched on which introduces precision resistor Rd in parallel with resistor Rc, thus reducing the tapped-off voltage being fed through capacitor Ci. This voltage reduction simulates, at the input of pre-amplifier 132 a reduction in the reactance X of coil 104, i.e. $\delta X_d$ of FIG. 8. However, if only that were done, the coil current would increase because the total resistance in series with coil 104 has been decreased. To compensate for this, and ensure that the coil current remains unchanged, resistor Ra is switched out by turning off transistor T1. The value of resistor Ra is chosen to then keep the coil current constant and so the simulation of the change in X is arranged not, in itself, to also simulate any change in coil loss R, i.e. the conditions necessary for the quadrature voltage across coil 104 to represent R are preserved. If, now, there is a change in R as measured by microprocessor 116 from the signal output from pre-amplifier 132, then that change is a consequence of the phase discrimination axes being displaced relative to the R and X axes, and is $\delta R_d$ of FIG. 8.

Having calculated $\theta_c$ or at least tan $\theta_c$, as $\Delta R_d/\Delta X_d$, if the resultant angle is greater than the minimum adjustment that can be applied to the digital generator 100, microprocessor 116 instructs the digital generator 100 to make that adjustment, in a sense which reduces the phase discrimination error. At such time as the measured error angle becomes less than the minimum adjustment step, microprocessor 116 sums it with the measured value $\theta_d$, so as to obtain the desired angle $\theta$ for the coin test. It should be appreciated that $\theta_c$ may be positive or negative so that the summing may either increase or decrease the measured value $\theta_d$.

The above computation and, if necessary, adjustment, of $\theta_c$ is carried out automatically under the control of microprocessor 116 at intervals, for example every three seconds, but only when no coin is present at the coil. After each occasion, transistors T1 and T2 are returned to the their normal operating condition, with T2 off and T1 on.

The circuitry may instead be adapted so as to simulate a change in R without simulating any change in X, and then calculating $\theta_c$ or tan $\theta_c$ from the measured value of $\Delta R_d$ and any resulting measured value of $\Delta X_d$.

A second function of the calibration and offset circuit 130 has already been briefly mentioned but will now be explained. It is the application of an offset voltage through capacitor Ci in 180° anti-phase to the X component of the voltage across coil 104 at the input of pre-amplifier 132. The reason for this is that in practice X is very much greater than R, typically about thirty times as great. Additionally, the changes $\Delta X$ and $\Delta R$ caused by a coin might typically be in the region of 20% of the coin-absent values of X and R. The X and R signals both have to be processed in the common channel of pre-amplifier 132 and phase sensitive detector 106 and with one signal approximately thirty times the size of the other an extremely poor signal-to-noise ratio would be obtained, possibly making any meaningful extraction of a $\Delta R$ measurement impossible. The offset applied to the X signal through capacitor Ci is substantial, so that it renders the X signal at the input of pre-amplifier 132 comparable in size to the R signal. Thus, greatly improved use is made of the dynamic range of the operational amplifier 132, and the signal-to-noise ratio can be made acceptable.

It is to be noted that the exact value of the offset voltage is not important, so long as it remains constant, because it is applied against both the coin-present and coin-absent X values and hence does not cause any alteration in the difference $\Delta X$ which is used in computing the angle $\theta$ or its tangent. No offset is applied against the R signal at the input of pre-amplifier 132.

Calibration and offset circuit 130 has a third function but it is necessary, before explaining it, to refer to a further technique used in testing coins, using the circuit of FIG. 7.

It has been explained above that measurement of the direction of the displacement line in the impedance plane is a good indicator of coin material and is substantially independent of the distance of the coin from the coil. Although this forms a useful coin test, it is not on its own usually sufficient for discriminating between different types of coins, because different types of coins are often made of the same material.

It is therefore desirable to sense at least one further coin characteristic, and coin diameter is a useful one. However, the direction of the displacement line (for example the angle $\theta$) is not sufficiently sensitive to coin diameter to provide a useful diameter test, even if the coil is made approximately as large as, or larger than, the largest-diameter coin to be tested. It is found that, when using the circuit of FIG. 7, and so long as the diameter of the inductor 104 is about as large as or larger than the diameter of the largest coin to be tested, the value of $\Delta X$ is usefully sensitive to coin diameter, and can be used as a second coin test, the coin only being accepted when its $\Delta X$ value corresponds to that of the same type of acceptable coin as does its displacement line direction.

However, unlike the ratio between $\Delta X$ and $\Delta R$, the value of the $\Delta X$ signal alone will be dependent upon the system gain, and this can be expected to vary with time and with temperature.

To compensate for the effect of such changes of gain on the measurement of $\Delta X$, the calibration and offset circuit 130 is periodically (for example on switching on, and every few minutes) operated as follows. As mentioned, transistor T2 is switched off during normal operation of the circuit. To calibrate for gain variations, transistor T1 is also switched off, thus taking resistor Ra out of the circuit. Since this is in parallel with Rb and Rc the total resistance is increased and the current through coil 104 falls. Since the three resistors Ra, Rb and Rc are precision resistors, they can be selected so that switching Ra out will repeatably produce a quite accurately constant percentage change in the coil current, for example 2%. So far as the X-component of the coil voltage is concerned, this will appear as a 2% decrease in the coil reactance. Naturally, the system will be designed to operate with some desirable level of overall gain from the coil 104 to the output of the digital-to-analogue converter 136. Suppose, for example, that the desired overall gain is such that a 2% change in the X-component of the coil voltage should produce a count change of 200 at the analogue-to-digital converter output. When T1 is switched off to cause the 2% change, the resulting change in counts at the output of the analogue-to-digital converter is checked by the microprocessor 116. If it is 200, no action is taken, but if it is different from 200, say n, then the compensation factor 200/n is calculated. Following this, transistor T1 is switched on again to return the circuit to its normal operating configuration and subsequently each time ΔX is calculated by the microprocessor 116 (based of course upon the count outputs of the analogue-to-digital converter 136 for coin-present and coin-absent X values), the result is multiplied by the compensation factor 200/n thus producing a ΔX value which has been compensated for variations in the system gain. In effect, variations in gain of the analogue components are measured and are then compensated for by multiplication at the digital stage such that constant gain is maintained as between the output from the coil and the final computed ΔX value.

The analogue-to-digital converter 136 forms a further common channel in which both the X and R signals are to be processed. When a coin passes the coil 104, the X signal decreases and the R signal increases. To optimise the use of the dynamic range or resolution of the analogue-to-digital converter and/or enable a converter of lower resolution and hence less cost to be used, further offsets are applied to both the X and R signals such that the coin-absent value of each signal lies close to the appropriate end of the dynamic range of the analogue-to-digital converter 136. These are D.C. offsets and are applied by the second offset circuit 134 under the control of microprocessor 116 and they have respective different values, one value for when the X signal is being processed or derived, and another for when the R signal is being processed or derived, the output of circuit 134 being switched accordingly in synchronism with the switching between the two differently-phased phase discrimination reference signals.

Figure 9:
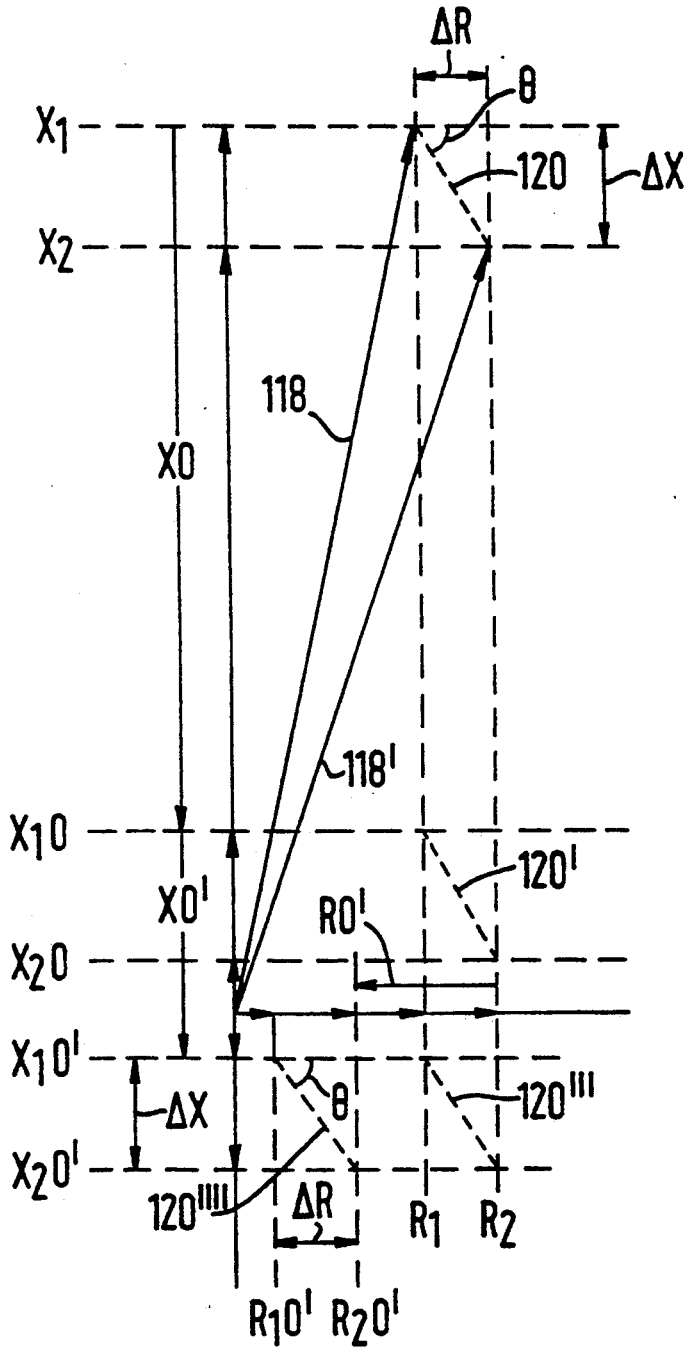
FIG. 9 is a further impedance plane diagram useful in understanding the effect of offsets which are applied within the circuit of FIG. 7.

The cumulative effects of all the offsets can be understood with reference to FIG. 9 which shows the same coin-present and coin-absent impedance vectors 118 and 118' as FIG. 3 on a more realistic scale with the X component very much larger than the R component. The coin-present and coin-absent X values are $X_1$ and $X_2$ respectively. The coin-present and coin-absent R values are $R_1$ and $R_2$ respectively, the two difference values being shown at top-right in FIG. 9, as ΔX and ΔR. These define the displacement line 120. The substantial first X offset voltage which is applied through capacitor Ci as was previously described is represented as Xo and reduces $X_1$ and $X_2$ to $X_{1o}$ and $X_{2o}$ where they are comparable in magnitude to $R_1$ and $R_2$, so that line 120 is shifted to 120'. The second X offset voltage, applied by second offset circuit 134, is represented as Xo' and shifts the voltages $X_{1o}$ and $X_{2o}$ to $X_{1o'}$ and $X_{2o'}$ respectively, thus shifting lines 120' to 120''. The R offset voltage from circuit 134 is indicated at Ro' and shifts the voltages $R_1$ and $R_2$ to $R_{1o'}$ and $R_{2o'}$ respectively, so that line 120'' shifts to 120'''. It can be seen from FIG. 9 that the idling or coin-absent X component value $X_{1o'}$ is close to zero. This places it near the bottom of the dynamic range of the analogue-to-digital converter 136. The coin-absent value of the R component signal $R_{1o'}$ is placed near the top of the dynamic range of the analogue-to-digital converter 136. The difference values ΔX and ΔR, and consequently the angle θ, remain unchanged by the application of the offsets, as indicated near the bottom left-hand corner of FIG. 9, and although the difference values are in opposite senses, they occupy different but substantially overlapping portions of the dynamic range of the analogue-to-digital converter so that the use of its dynamic range is optimised.

Figure 10:
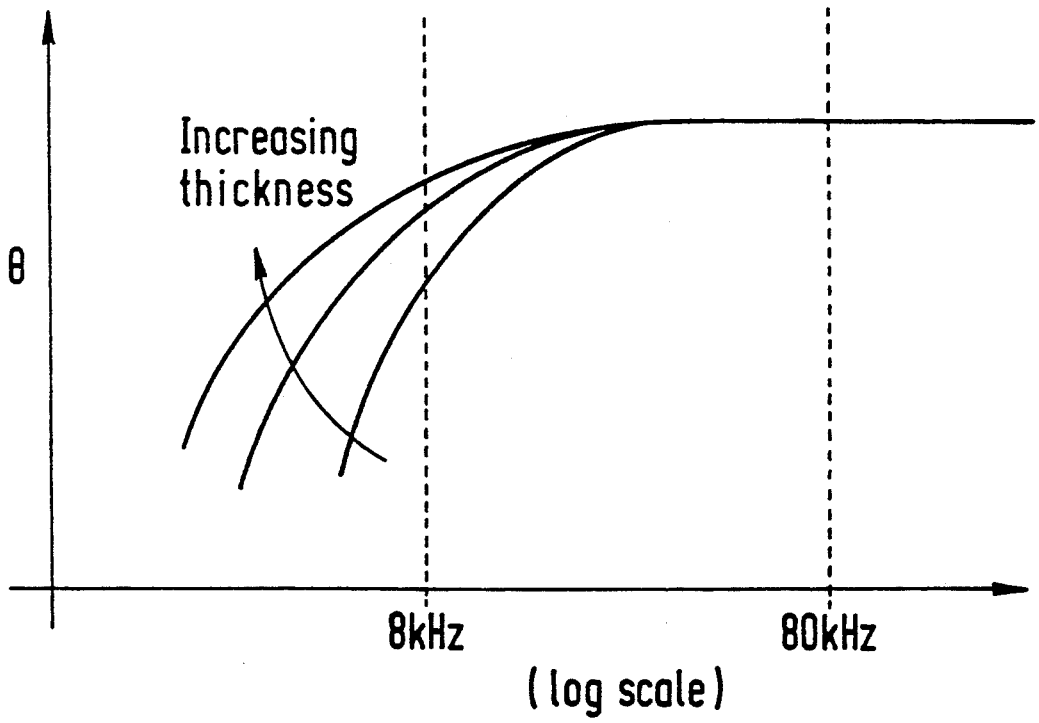
FIG. 10 is a graph showing how an angle $\theta$ measured in the impedance plane varies with thickness and with frequency when measurements are taken on test discs of the same material but of different thicknesses.

The angle θ discussed above and shown in the drawings, and the angle C shown in FIG. 4, are constant for a given coin material, so long as the coin is large enough to influence the whole of the field of coil 104, at the frequencies that are most commonly used in testing coins. However, as the frequency is decreased below the most commonly used ranges, for example to below 20 kHz, so the angle θ starts to change, the change being dependent on the thickness of the coin. FIG. 10 shows a set of three curves which represent the values of the angle θ for three test discs which are of the same material but which differ in thickness, and the values of θ being shown over a range of frequencies (on a logarithmic scale) at which coil 104 may be driven. The thinner the disc, the higher the frequency at which the thickness starts to influence the angle θ, and vice versa. Generally, the thickness-dependence of the angle θ becomes significant when the frequency is reduced to the point where the skin depth of the field in the material is about one third of the thickness of the material. It can be seen from FIG. 10 that when the frequency is high enough for the skin depth to be much less than the thickness of all of the test discs, the thickness-dependence of the angle θ disappears. The higher the conductivity of the material, the less the skin depth at a given frequency. Consequently it is necessary to go to lower frequencies to achieve useful thickness-dependence for the higher conductivity coin materials. The US coin set is primarily of relatively high conductivity materials and to achieve thickness sensitivity with that coin set, and with magnetic coins, it is preferred to use a frequency of 10 kHz or less, for example less than 6 kHz. For cupro-nickel, which is common among the UK coin set, the conductivity is lower and the skin depth greater at a given frequency, so that significant thickness-dependence can be obtained at frequencies below 100 kHz, preferably below 50 kHz and even more preferably below 35 kHz where the effect is greater. Although at these lower frequency ranges the angle θ is dependent on coin thickness as well as material, it remains to a very large extent independent of the spacing of the coin from the coil and so a reliable thickness dependent measurement can be made using a single coil located to one side of the coin path.

A practical coin testing apparatus has been constructed which employs the techniques described herein with reference to FIG. 7 and which employs two testing inductors comparable with the inductor 104. Both inductors were located on the same side of the coin path. The first inductor consisting of an annular coil set into a ferrite pot core was 14 mm in diameter and was driven at 8 kHz. The second, regarded in the direction of coin travel, was of similar construction but 37.5 mm in diameter and was driven at 115 kHz. The first was smaller in diameter than the smallest coin to be accepted and was set above the coin track so as to always be completely occluded by the coin when the coin was centred relative to the coil. Since this inductor was driven at the relatively low frequency of 8 kHz, the value of angle θ derived using this coil was dependent on both the material and the thickness of the coin. The second inductor was of a diameter greater than that of the largest coin to be accepted and was set with its bottom edge level with the coin track. The higher frequency of 115 kHz ensured that the angle $\theta$ derived using this inductor would be substantially independent of coin thickness, but the large diameter of the coil rendered the angle $\theta$ sensitive to the diameter or area of the coin as well as its material. This inductor was positioned downstream on the coin path to allow any bouncing of the coin to cease, which otherwise would influence the diameter-sensitive measurement on the coin. Such bouncing would have less influence on the output of the much smaller thickness-sensitive inductor.

Both coils were driven by the same digital signal generator 100 and the output signals from both coils were processed, referring to FIG. 7, by the same preamplifier 132 and the further components right through to the microprocessor 116. Each of the inductors was provided with its own filter 102, drive transistor 103 and calibration and offset circuit 130 and the two groups of these components were switched into and out of the circuitry of FIG. 7, alternately, at the points marked P in FIG. 7 under the control of microprocessor 116 which simultaneously switched generator 100 between the higher and the lower frequencies appropriate to the two inductors.

As described, measurements are made when the displacement line direction, and $\Delta X$ itself, are at extremes, but it is also possible to use measurements taken at other times during the passage of a coin past a sensor, as is known, and the technique described may be used in that way also.

Although in the embodiments described above a phase discrimination method is used to derive X, R, $\Delta X$ and $\Delta R$, it will be appreciated that various novel and inventive aspects of those embodiments are usable even if alternative methods (such as will be described with reference to FIGS. 11 and 12) are used for those derivations, such as using $\Delta X$ as an acceptability criterion in addition to displacement line direction, and using displacement line direction at lower frequencies as a thickness-responsive measurement.

The described technique for compensating for gain variations is usable in coin mechanisms irrespective of the origin or significance of the signals being processed.

The apparatus of FIG. 11 will now be described in detail. A pi-configuration tuned circuit 2 includes an inductor in the form of a single coil 4, two capacitors 6 and 7 and a resistor 8. Resistor 8 is not normally a separate component and should be regarded as representing the effective loss in the tuned circuit, which will consist primarily of the inherent loss of the coil 4.

Means is provided for positioning a coin shown in broken lines at 10 adjacent to the coil 4, the means being shown schematically as a coin passageway 12 along which the coin moves on edge past the coil. As the coin 10 moves past the coil 4, the total effective loss in the tuned circuit increases, reaching a peak when the coin is centred relative to the coil, and then decreases to an idling level. In the present example the apparatus is responsive to the peak value of this effective loss.

The tuned circuit 2 is provided with a feedback path so as to form a free-running oscillator. The feedback path is generally indicated at 14 and includes a line 16 which carries the voltage occurring at one point in the tuned circuit, a switching circuit 18, and an inverting amplifier 20 which provides gain in the feedback path. A phase delay circuit shown schematically at 24 is alternately switched into the feedback path, or by-passed, depending on the condition of switching circuit 18. The phase shift round the feedback path is 180° when the phase delay circuit 24 is not switched into it, and the phase shift across the pi-configuration tuned circuit is then also 180°. In this condition the oscillator runs at its resonant frequency.

Figure 12:
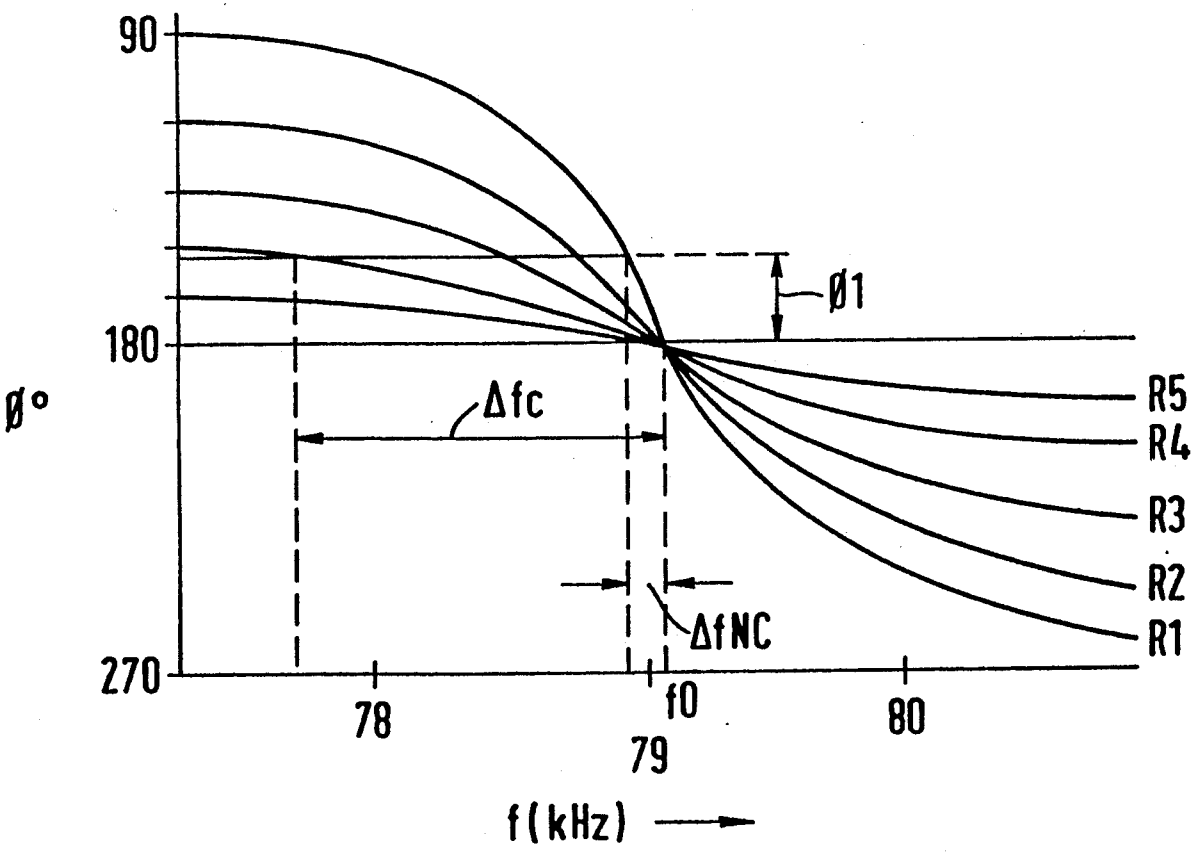
FIG. 12 illustrates the relationship between frequency, phase and effective resistance in the tuned circuit of FIG. 11.

It is convenient now to refer to FIG. 12. FIG. 12 shows the relationship between frequency of oscillation and amount of phase shift ($\phi$) in the feedback path for five different values of total effective loss in the tuned circuit, from a relatively low value R1 to a relatively high value R5. In general terms, for a pi-configuration tuned circuit in which the effective loss is variable, the amount of effective loss in the circuit at any particular time can be determined by changing the amount of phase shift in the feedback path from one known value to another (or by a known amount) and measuring the resulting change in frequency. The relationship between the phase shift change and the frequency change effectively represents the gradient of one of the curves shown in FIG. 12 and consequently indicates on which curve the circuit is operating and hence what is the present effective loss in the circuit. For example, if the phase shift is changed from 180° by an amount $\phi 1$ (which may be about 30°) as shown and the frequency changes by $\Delta fNC$ then the effective loss is the low value R1; but, if the frequency changes by the larger amount $\Delta fC$ the effective loss is the higher value R4.

Figure 11:
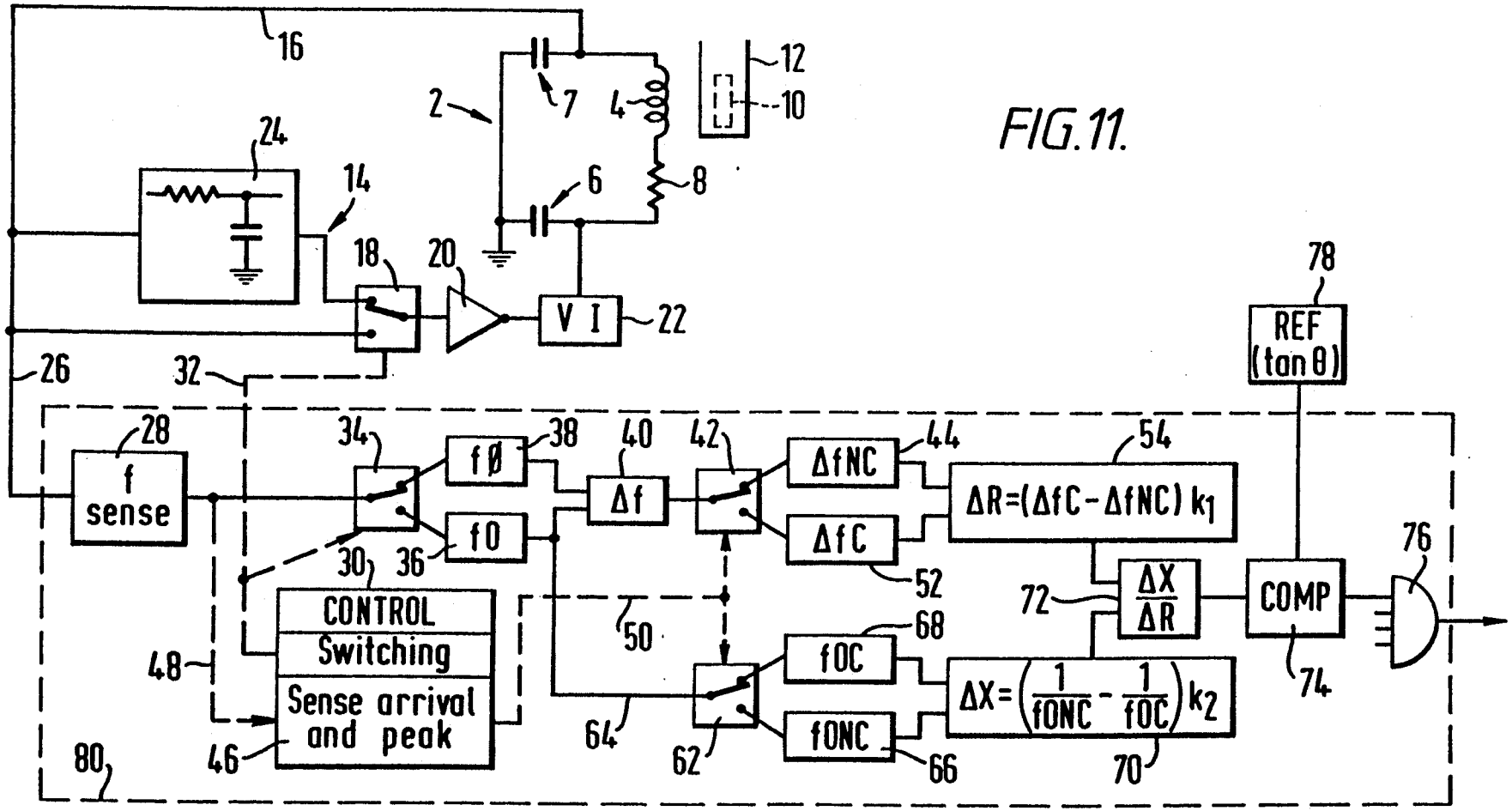
FIG. 11 shows schematically a further coin testing apparatus utilising the invention, in which the X and R signals are developed using a free running oscillator instead of a driven coil.

This is implemented by the circuitry schematically shown in FIG. 11, the description of which will now be completed.

The frequency of the oscillator is fed on line 26 to a frequency sensing circuit 28. A control circuit 30 repeatedly operates switching circuit 18 by a line 32 to switch the phase delay circuit 24 into and out of the oscillator feedback path. Via the same line 32 it also operates a switch 34 in synchronism with switching circuit 18 so that the values of the frequency sensed by sensing circuit 28 are stored in store 36 (this being the frequency value when the phase delay is not present in the oscillator circuit) and store 38 (this being the frequency value when the phase delay is introduced into the oscillator circuit). FIG. 11 and the following description may be better understood by reference to the following table of the notation used for various frequencies and frequency differences:

$fO$ = frequency without phase shift
$f\phi$ = frequency with phase shift
$\Delta f = f\phi - fO$
$\Delta fNC = \Delta f$ when coin absent
$\Delta fC$ = peak value of $\Delta f$ when coin present
$fOC$ = peak value of $fO$ when coin present
$fONC$ = value of $fO$ when coin absent A subtracter 40 subtracts $fO$ from $f\phi$ to develop $\Delta f$ and, in the normal condition of a switch 42, this value of $\Delta f$ is passed to a store 44. This normal condition prevails while there is no coin adjacent to coil 4, in which case the effective loss in the tuned circuit is low (say, the low value R1 of FIG. 12) and the frequency difference value being stored at 44 is then $\Delta fNC$ (indicated in FIG. 12), this value being indicative of the inherent effective loss of the tuned circuit itself at the time when the measurements are being taken.

As a coin 10 begins to arrive adjacent to coil 4, $fO$ at the output of frequency sensing circuit 28 starts to change. A section 46 of control circuit 30 detects the beginning of this change from line 48 and in response changes the condition of switch 42 via line 50, causing the recent idling value of $\Delta fNC$ to be held in store 44.

As the coin 10 approaches and reaches a position central relative to coil 4, so the frequency fO falls until it reaches a peak low value. Circuit section 46 is adapted to detect this peak occurring and, in response, it causes switch 42 to direct the value of $\Delta f$ occurring when the coin is centred, to store 52. This is value $\Delta fC$, for example, as shown on FIG. 12, and it is the maximum value of frequency shift resulting from the imposed phase change $\phi 1$ that occurs during the passage of the coin past the inductor. This frequency shift indicates that the total effective loss in the tuned circuit is now the relatively high value R4 consisting of the effective loss inherent in the circuit plus the effective loss introduced into it by the particular coin which is now centred on the coil 4. The effective loss R of the coil is $k_1\Delta f$ where $k_1$ is a constant. A value indicative of the effective loss introduced by the coin alone is then derived by circuit 54 which subtracts $\Delta fNC$ from $\Delta fC$ and multiplies by the constant $k_1$. This is equal to $\Delta R$ as previously referred to.

The circuit of FIG. 11 also measures $\Delta X$, the amount of reactance introduced by the coin into the tuned circuit 2, as follows. The value of fO (i.e. oscillation frequency without any imposed phase shift) is applied to a switch 62 via line 64. Switch 62 is operated by the arrival sensing and peak detecting section 46 of control circuit 30 in the same manner as switch 42. Consequently, the coin-absent or idling frequency without phase delay becomes stored in store 66, and the coin-present peak low frequency reached without phase delay as the coin passes the inductor 4 becomes stored in store 68. These frequencies are indicative of the total reactance in the tuned circuit itself, and with the additional influence of the coin, respectively. The effective reactance X of the coil is $k_2/fO$ where $k_2$ is a constant. $\Delta X$ is derived by circuit 70 which takes the reciprocals of both frequencies, subtracts them, and multiplies by constant $k_2$.

The outputs of circuits 54 and 70 are fed to a divider 72 which takes $\Delta X/\Delta R$ (i.e. $\tan\theta$ for the coin being tested) and passes it to a comparator 74 where it is compared with a reference value of $\tan\theta$ from reference circuit 78. If they correspond, the comparator 74 provides an output to AND gate 76.

In practice, one or more other tests will be carried out on the coin, and for each test value that matches a reference value, for the same type of coin, a further input is applied to AND circuit 76. When all the inputs, one for each of the tests, are present, indicating that the coin being tested has produced a complete set of values matching the respective reference values for a given denomination of coin, the AND circuit 76 produces an accept signal at its output to cause the coin to be accepted, for example by operating an accept/reject gate in well known manner. Additional tests may also be used, of course, in conjunction with those described earlier with reference to FIGS. 1 to 10.

The embodiment of FIG. 11 has been described above, and illustrated, in terms of switches and functional blocks, but in practice all the components shown within the broken-line box 80 are preferably implemented by means of a suitably programmed microprocessor. The programming falls within the skills of a programmer familiar with the art, given the functions to be achieved as explained above.

Although the inductor is shown as a single coil, it may have other configurations, such as a pair of coils opposed across the coin passageway and connected in parallel or series, aiding or opposing.

As described, measurements are made when the oscillator frequency is at a peak value, but it is also possible to take useful measurements at other times during the passage of a coin past a sensor, as is known, and the technique of FIGS. 11 and 12 may be used in that way also.

It will be understood that, to take account of the fact that even acceptable coins of a given denomination vary to some degree in their properties, any comparisons made for checking acceptability in any of the embodiments will allow for this, for example by having the reference values in the form of a range defined by upper and lower limits or by applying a tolerance to the measured value before comparing with an exact reference. All reference values may be stored, for example in the memory of a microprocessor or in a separate digital memory, or they may be calculated from stored coin-related information whenever required.

We claim:

1. A method of testing a coin in a coin testing mechanism, comprising subjecting a coin inserted into the mechanism to an oscillating field generated by an inductor, measuring the reactance and the loss of the inductor when the coin is in the field, and determining whether the direction in the impedance plane of a displacement line, representing the displacement of a coin-present point which is defined by the measurements, relative to a coin-absent point representing the inductor reactance and loss in the absence of a coin, corresponds to a reference direction in the impedance plane.

2. A method as claimed in claim 1 wherein the reactance and loss measurements are made by a phase discrimination method.

3. A method as claimed in claim 2 comprising driving the inductor from a signal source.

4. A method as claimed in claim 3 wherein said signal source acts as a constant current source.

5. A method as claimed in claim 2 comprising sampling the voltage across the inductor at times substantially 90° separated in phase to derive respective signals representing the inductor reactance and loss.

6. A method as claimed in claim 2 comprising measuring the angular displacement in the impedance plane of phase discrimination axes relative to true reactance and loss axes.

7. A method as claimed in claim 6 comprising measuring said angular displacement by simulating a change in only the reactance or the loss of the inductor when a coin is not in the field, detecting the resulting change in the loss or reactance measurements made by said phase discrimination method, and calculating said angular displacement from the relationship between the simulated change and the detected resulting change.

8. A method as claimed in claim 7 wherein the simulated change is in only the reactance of the inductor, and the resulting change in the loss measurement is detected.

9. A method as claimed in claim 6 comprising angularly shifting the phase discrimination axes to reduce said angular displacement.

10. A method as claimed in claim 6 comprising, in said determining step, applying a correction factor derived from said angular displacement measurement.

11. A method as claimed in claim 1 wherein said reference direction is established as an angle relative to one of reactance and loss axes.

12. A method as claimed in claim 11, wherein the reactance and loss measurements are made by a phase discrimination method and said determining step includes evaluating the angle of said displacement line relative to one of phase discrimination axes.

13. A method as claimed in claim 12 comprising, in said determining step, applying a correction factor based on measured angular displacement in the impedance plane of the phase discrimination axes relative to the reactance and loss axes, and on said evaluated angle of the displacement line.

14. A method as claimed in claim 1 wherein the coin-absent point is defined by measuring the reactance and loss of the inductor in the absence of a coin and the direction of said displacement line is ascertained from the coin-present and coin-absent measurements.

15. A method as claimed in claim 14 wherein the coin-absent measurements are taken each time a coin is tested.

16. A method as claimed in claim 1 comprising providing a reference displacement line whose direction in the impedance plane is said reference direction and whose position in the impedance plane is such that it extends through the coin-absent point, and wherein said determining step comprises determining whether the coin-present reactance and loss measurements define a point lying substantially on the reference displacement line.

17. A method as claimed in claim 1 wherein said determining step includes evaluating the angle of said displacement line relative to a coin-absent total impedance vector of the inductor.

18. A method as claimed in claim 17 wherein the reactance and loss measurements are made by a phase discrimination method and said evaluation comprises measuring the angle of said coin-absent total impedance vector relative to a phase discrimination axis, measuring the angle of said displacement line relative to a phase-discrimination axis, and combining these two measured angles.

19. A method as claimed in claim 17 wherein said reference direction is established as an angle relative to the coin-absent total impedance vector of the inductor in the impedance plane.

20. A method as claimed in claim 1, wherein signals dependent upon the reactance and the loss, respectively, of the inductor are processed in a common channel, the difference between coin-present and coin-absent values of the reactance-dependent signal is utilised in said determining step, and prior to said processing an offset is applied to the reactance-dependent signal to substantially reduce its value towards that of the loss dependent signal.

21. A method as claimed in claim 20 wherein from said common channel the signals pass to a further common channel, the difference between coin-present and coin-absent values of both the reactance-dependent and the loss-dependent signals is utilised in said determining step, and prior to said further common channel an offset is applied to at least one of the signals such that the coin-absent value of the at least one signal is close to an end of a dynamic range of a component of the further common channel, whereby to optimise use of the dynamic range of said component.

22. A method as claimed in claim 21 wherein said component is an A-D converter.

23. A method as claimed in claim 1 wherein said reference direction is related to a particular coin type, and further comprising determining whether the difference between coin-absent and coin-present values of the reactance of the inductor corresponds to a reference value related to the same particular coin type.

24. A method as claimed in claim 23 comprising compensating for the effect of varying system gain on said difference between reactance values by simulating, from time to time, a predetermined change in the reactance of the inductor when a coin is not in the field, detecting the resulting change in a signal dependent on said reactance which signal has been subjected to said system gain, comparing the detected change with a reference value, applying to said reactance-dependent signal a compensation factor derived from the result of said comparison such as to adjust that signal to substantially correspond with the reference value, and maintaining the application of said compensation factor until the next time said change is simulated.

25. A method as claimed in claim 24 wherein said signal dependent on said reactance is an analogue signal, comprising converting said analogue signal to digital form before detecting said resulting change, comparing the change in the digital form of the dependent signal with a digital reference value, deriving from the comparison a digital compensation factor, and applying the digital compensation factor to the digital form of the reactance-dependent signal until the next time said change is simulated.

26. A method as claimed in claim 1 wherein the frequency of the oscillating field generated by the inductor is sufficiently low that the direction of said displacement line is influenced by the thickness of the coin being tested.

27. A method as claimed in claim 26 wherein said frequency is sufficiently low that its skin depth for the coin material is more than one third of the thickness of the coin.

28. A method as claimed in claim 26 wherein said frequency is 100 kHz or less.

29. A method as claimed in claim 26 wherein said frequency is 35 kHz or less.

30. A method as claimed in claim 26 wherein said frequency is 10 kHz or less.

31. A method as claimed in claim 1 comprising generating said oscillating field from only one side of the coin.

32. A method as claimed in claim 1 wherein the determining step is carried out in relation to a plurality of reference directions which correspond respectively to a plurality of acceptable coin types.

33. A method as claimed in claim 1 wherein said determining step is carried out at least when a value related to the direction of said displacement line reaches an extreme during the passage of a coin past the inductor.

34. A method as claimed in claim 33 comprising repeatedly evaluating the direction of said displacement line as the coin moves edgewise past the inductor, and detecting from the results of the evaluations when the value is at an extreme.

35. A coin testing mechanism comprising a coin passageway, circuitry including an inductor, adapted to cause the inductor to generate an oscillating field in the coin passageway, means adapted to measure the reactance and the loss of the inductor when the coin is in the field, and means for determining whether the direction in the impedance plane of a displacement line, representing the displacement of a coin-present point defined by the measurements relative to a coin-absent point representing the inductor reactance and loss in the absence of a coin, corresponds to a reference direction in the impedance plane.

36. A mechanism as claimed in claim 35 wherein said means adapted to measure the reactance and the loss of the inductor when the coin is in the field includes phase discrimination circuitry.

37. A mechanism as claimed in claim 36 comprising a signal source arranged to drive the inductor.

38. A mechanism as claimed in claim 37 wherein said signal source is a constant current source.

39. A mechanism as claimed in claim 36 wherein the phase discrimination circuitry is adapted to sample the voltage across the inductor at times substantially 90° separated in phase to derive respective signals representing the inductor reactance and loss.

40. A mechanism as claimed in claim 36 comprising means for measuring the angular displacement in the impedance plane of phase discrimination axes relative to true reactance and loss axes.

41. A mechanism as claimed in claim 40 comprising means for simulating a change in only the reactance or the loss of the inductor when a coin is not in the field, means for detecting the resulting change in the loss or reactance measurements, and means for calculating said angular displacement from the relationship between the simulated change and the detected resulting change.

42. A mechanism as claimed in claim 41 wherein the simulating means is adapted to simulate a change in only the reactance of the inductor, and the detecting means is adapted to detect the resulting change in the loss measurement.

43. A mechanism as claimed in claim 41 wherein said simulating means is adapted to temporarily sum with an inductor signal a signal having the same frequency as the inductor signal and which is in phase with or 180° out of phase with that component of the inductor signal which represents the impedance component in which the change is to be simulated.

44. A mechanism as claimed in claim 42 comprising a resistor network connected in circuit with the inductor, means connecting the inductor to an input of the phase discrimination circuitry to apply the voltage across the inductor to said circuitry, and a capacitor connected from a point in said resistor network to said input whereby to feed to said input a voltage 180° out of phase with the inductor voltage.

45. A mechanism as claimed in claim 44 comprising first means for modifying said resistor network to temporarily change the voltage fed through said capacitor thus simulating said reactance change.

46. A mechanism as claimed in claim 45 comprising second means for modifying said resistance network such as to cancel any change in inductor current that would be caused by operation of said first means.

47. A mechanism as claimed in claim 40 comprising means for angularly shifting the phase discrimination axes on which said phase discrimination circuitry operates so as to reduce said angular displacement.

48. A mechanism as claimed in claim 40 wherein said determining means includes means for applying a correction factor derived from said angular displacement measurement.

49. A mechanism as claimed in claim 40 in which the inductor is driven at a frequency determined by a digital signal generator.

50. A mechanism as claimed in claim 49 comprising an analogue filter arranged to filter the output of the digital signal generator before it is applied to the inductor.

51. A mechanism as claimed in claim 35 comprising means for establishing said reference direction as an angle relative to one of reactance and loss axes.

52. A mechanism as claimed in claim 51, comprising phase discrimination circuitry adapted to measure the reactance and loss of the inductor and wherein said determining means is adapted to evaluate the angle of said displacement line relative to one of phase discrimination axes.

53. A mechanism as claimed in claim 52 wherein said determining means includes means for applying a correction factor based on measured angular displacement in the impedance plane of the phase discrimination axes relative to the reactance and loss axes, and on said evaluated angle of the displacement line.

54. A mechanism as claimed in claim 35 wherein the measuring means is further adapted to measure the reactance and loss of the inductor in the absence of a coin to establish the coin-absent point and comprising means for determining the direction of said displacement line from the coin-present and coin-absent measurements.

55. A mechanism as claimed in claim 54 comprising means for causing the measuring means to take the coin-absent measurements each time a coin is tested.

56. A mechanism as claimed in claim 35 comprising means for providing a representation of a reference displacement line whose direction in the impedance plane is said reference direction and whose position in the impedance plane is such that it extends through the coin-absent point, and wherein said determining means is adapted to determine whether the coin-present reactance and loss measurements define a point lying substantially on the reference displacement line.

57. A mechanism as claimed in claim 35 wherein said determining means is adapted to evaluate the angle of said displacement line relative to a coin-absent total impedance vector of the inductor.

58. A mechanism as claimed in claim 57, comprising phase discrimination circuitry adapted to measure the reactance and loss of the inductor and wherein said determining means is operable to measure the angle of said coin-absent total impedance vector relative to a phase discrimination axis, measure the angle of said displacement line relative to the phase-discrimination axis, and combine these two measured angles.

59. A mechanism as claimed in claim 57 comprising means for establishing said reference direction as an angle relative to the coin-absent total impedance vector of the inductor in the impedance plane.

60. A mechanism as claimed in claim 35, comprising a common channel in which signals dependent upon the reactance and the loss, respectively, of the inductor are processed, said determining means being adapted to utilise the difference between coin-present and coin-absent values of the reactance-dependent signal, and means for applying an offset to the reactance-dependent signal to substantially reduce its value towards that of the loss-dependent signal.

61. A mechanism as claimed in claim 60 wherein from said common channel the signals pass to a further common channel, said determining means is adapted to utilise the difference between coin-present and coin-absent values of both the reactance-dependent and the loss-dependent signals in said determining step and, prior to said further common channel, means is provided for applying an offset to at least one of the signals such that the coin-absent value of the at least one signal is close to an end of a dynamic range of a component of the further common channel, whereby to optimise use of the dynamic range of said component.

62. A mechanism as claimed in claim 61 wherein said component is an A-D converter.

63. A mechanism as claimed in claim 35 wherein said reference direction is related to a particular coin type, and said determining means is further adapted to determine whether the difference between coin-absent and coin-present values of the reactance of the inductor corresponds to a reference value related to the same particular coin type.

64. A mechanism as claimed in claim 63 wherein signals dependent on inductor reactance are processed by circuitry subject to varying system gain which will affect said difference between reactance values, comprising means for simulating, from time to time, a predetermined change in the reactance of the inductor when a coin is not in the field, means for detecting the resulting change in a signal dependent on said reactance which signal has been subjected to said system gain, means for comparing the detected change with a reference value, means for applying to said reactance-dependent signal a compensation factor derived from the result of said comparison such as to adjust that signal to substantially correspond with the reference value, and means for maintaining the application of said compensation factor until the next time said change is simulated.

65. A mechanism as claimed in claim 64 wherein said signal dependent on said reactance is an analogue signal, comprising means for converting said analogue signal to digital form before detecting said resulting change, means for comparing the change in the digital form of the signal with a digital reference value, means for deriving from the comparison a digital compensation factor, and means for applying the digital compensation factor to the digital form of the reactance-dependent signal until the next time said change is simulated.

66. A mechanism as claimed in claim 35 wherein the frequency of the oscillating field generated by the inductor is sufficiently low that the direction of said displacement line is influenced by the thickness of the coin being tested.

67. A mechanism as claimed in claim 66 wherein said frequency is sufficiently low that its skin depth for the coin material is more than one third of the thickness of the coin.

68. A mechanism as claimed in claim 66 wherein said frequency is 100 kHz or less.

69. A mechanism as claimed in claim 66 wherein said frequency is 35 kHz or less.

70. A mechanism as claimed in claim 66 wherein said frequency is 10 kHz or less.

71. A mechanism as claimed in claim 35 wherein said inductor is on only one side of the coin passageway.

72. A mechanism as claimed in claim 35 comprising means for providing a plurality of reference directions which correspond respectively to a plurality of acceptable coin types, and wherein said determining means is adapted to carry out said determining step in relation to said plurality of reference directions.

73. A mechanism as claimed in claim 56 wherein said providing means is adapted to provide representations of a plurality of reference displacement lines whose directions correspond respectively to a plurality of acceptable coin types, and wherein said determining means is adapted to carry out said determining step in relation to said plurality of reference displacement lines.

74. A mechanism as claimed in claim 35 comprising means for detecting a value related to the direction of said displacement line reaching an extreme during the passage of a coin past the inductor, and wherein said determining means is adapted to use said extreme value.

75. A mechanism method as claimed in claim 74 wherein said detecting means is operable to repeatedly evaluate the direction of said displacement line as the coin moves edgewise past the inductor, and to detect from the results of the evaluations when the value is at an extreme.

* * * * *

UNITED STATES PATENT AND TRADEMARK OFFICE

CERTIFICATE OF CORRECTION

PATENT NO. : 5,213,190

DATED : May 25, 1993

INVENTOR(S) : Furneaux, et al.

It is certified that error appears in the above—identified patent and that said Letters Patent is hereby corrected as shown below:

Column 5, line 29, change "a, c and d" to -- b, c and d --.

Column 7, line 55, insert -- b -- after "point".

Claim 20, column 19, lines 52-53 change "loss dependent" to -- loss-dependent --.

Signed and Sealed this

Twenty-sixth Day of April, 1994

Bruce Lehman

*Attest:*

BRUCE LEHMAN

*Attesting Officer*

*Commissioner of Patents and Trademarks*